US005729083A

United States Patent [19]

Horne et al.

[11] Patent Number: 5,729,083

[45] Date of Patent: Mar. 17, 1998

[54] PICTURE DISPLAY DEVICE PROVIDED WITH AN INTERNAL VACUUM SUPPORT

[75] Inventors: Remko Horne; Gerardus N. A. Van Veen; Petrus J. M. Peters, all of Eindhoven, Netherlands

[73] Assignee: U.S. Philips Corporation, New York, N.Y.

[21] Appl. No.: 544,796

[22] Filed: Oct. 18, 1995

[30] Foreign Application Priority Data

Oct. 31, 1994 [EP] European Pat. Off. ..... 94203157
Feb. 24, 1995 [EP] European Pat. Off. ..... 95200466

[51] Int. Cl.[6] ..... H01J 29/70

[52] U.S. Cl. ..... 313/422; 313/495; 313/497

[58] Field of Search ..... 313/422, 495, 313/497, 496, 426, 460

[56] References Cited

U.S. PATENT DOCUMENTS

| | | | |
|---|---|---|---|
| 5,003,219 | 3/1991 | Muragishi et al. | 313/422 |
| 5,270,611 | 12/1993 | Van Gorkom . | |
| 5,313,136 | 5/1994 | Van Gorkom et al. | 313/422 |
| 5,347,199 | 9/1994 | Van Gorkom et al. | 313/422 |

FOREIGN PATENT DOCUMENTS

| | | |
|---|---|---|
| 0400750 | 12/1990 | European Pat. Off. . |
| 0436997 | 7/1991 | European Pat. Off. . |
| 0496450 | 7/1992 | European Pat. Off. . |
| 0562670 | 9/1993 | European Pat. Off. . |

OTHER PUBLICATIONS

St. Regis Paper Co. J. Bemis Co. Inc 193 VSPQ 8,11 (7th Cir. 1977).

*Primary Examiner*—Sandra L. O'Shea
*Assistant Examiner*—Joseph Williams
*Attorney, Agent, or Firm*—Arthur G. Schaier

[57] ABSTRACT

A picture display device having an evacuated envelope (1) comprises a first wall (2) which is provided with a display screen (3), and a second wall (5), and is provided with an internal vacuum support (11) between the two walls (2, 5). The internal vacuum support (11) comprises a dielectric plate at least at the side facing the first wall (2), which plate is arranged opposite the display screen (3) and is provided with cavities (12) at the location of the pixels (4R, 4B, 4G) of the display screen (3). The internal vacuum support (11) accommodates cavities (12) which constitute a lateral system of ducts. The continuous exhaust path of the internal vacuum support (11) communicates via the exhaust cavity (25) with an exhaust connection (9).

12 Claims, 6 Drawing Sheets

PICTURE DISPLAY DEVICE PROVIDED WITH AN INTERNAL VACUUM SUPPORT

The invention relates to a picture display device provided with an evacuated envelope comprising a first, at least substantially flat transparent wall provided with a display screen having a regular pattern of electroluminescent pixels, and a second, at least substantially flat wall extending parallel to the first wall, said picture display device comprising at least one electron source, while in a gap between the first and the second wall an internal vacuum support is arranged having apertures for passing electrons to the pixels.

BACKGROUND OF THE INVENTION

A device of the type described in the opening paragraph is known from U.S. Pat. No. 5,270,611. Such a device generally comprises per pixel, group of pixels or per series of pixels, a separate electron source, for example in the form of a field emitter, a wire cathode or a PN emitter. Such a device is considerably flatter than a conventional display tube. This renders a device of the type described in the opening paragraph particularly suitable for laptop computers and other applications aiming at compactness.

However, such a relatively flat display device imposes special requirements on its construction. Since a vacuum is maintained internally, the envelope should be capable of withstanding an atmospheric pressure. This may be achieved, for example by using extra thick walls in the picture display device, but particularly for relatively large picture surface areas this will soon lead to an unacceptable glass thickness and also weight. An alternative is the use of an internal vacuum support as used, for example in the device of the type described in the opening paragraph.

Such a device is known from EP-A-562670. This document describes a picture display device in which a first, at least substantially flat transparent wall referred to as the display panel is provided with a display screen at its inner side. Arranged opposite this wall and at some distance therefrom is a second, at least substantially flat wall extending parallel to the first wall and having the form of a substrate, a main surface of which is provided with groups of a (large) number of field emitters. The gap thus formed between the two plates incorporates an internal vacuum support which engages the first wall and the second wall. The internal vacuum support comprises a dielectric plate having a large number of conical cavities which widen in the direction of the display window and each enclose a pixel.

The internal vacuum support of the known device also constitutes an adequate pixel separation because the walls of the cavities extend uninterruptedly from the second wall to the display screen and thus prevent electrons generated by a group of field emitters from penetrating an adjacent cavity and impinging upon the wrong pixel. A drawback of the known device is, however, that it is not possible in a relatively large picture surface area to build up a sufficient vacuum in the envelope because the internal vacuum support used therein with cavities which are sealed all round has a too large exhaust resistance.

This drawback does not apply to an internal vacuum support in the form of separate dielectric pellets, referred to as balletinos which are scattered between the pixels. However, such pellets are not very well applicable for higher resolutions because their diameter is essentially equal to the distance between the two plates, which distance should have a given minimum value so as to avoid flashover between the first and the second wall. Consequently, when balletinos are used, the pitch of the pixels cannot be smaller or can hardly be smaller than the distance between the two plates, which is typically of the order of 0.1–0.2 ram. Moreover, balletinos do not provide pixel separation or only a limited pixel separation.

EP-A-496450 describes a vacuum support which laterally has an open structure at a first level and thus allows a relatively low exhaust resistance, and constitutes a pixel separation at a second level. However, this known vacuum support made of an organic polymer requires a comparatively complicated and time-consuming manufacturing process, while in some cases the (high) voltage stability of the vacuum support has turned out to be insufficient in practice. In fact, the vacuum support should be resistant to the conventional post-acceleration voltages of several kilovolts, which voltages are applied in many cases between the second wall and the first wall spaced apart therefrom by a short distance.

SUMMARY OF THE INVENTION

It is an object of the present invention to provide, inter alia a picture display device of the type described in the opening paragraph with an internal vacuum support allowing a high picture resolution, a comparatively low exhaust resistance and a large high-voltage stability.

According to the invention, a picture display device of the type described in the opening paragraph is therefore characterized in that at least the side of the internal vacuum support facing the display screen comprises a dielectric plate which is arranged opposite the display screen and is provided with cavities, each cavity facing at least one pixel, in that the internal vacuum support comprises a lateral system of ducts, each cavity communicating with at least one duct, each duct communicating with an exhaust connection, and in that at least the surface of the internal vacuum support consists of an inorganic material. The walls between adjacent cavities of the dielectric plate may be thinner than the distance between the two plates so that picture resolutions which are considerably higher than those with balletinos are feasible. Since the internal vacuum support further comprises a lateral system of ducts, by means of which the separate cavities communicate with the exhaust connection, the exhaust resistance of the entire structure may remain limited and may be particularly considerably smaller than that of the internal vacuum support of the picture display device known from EP-A-496450. The picture display device according to the invention thus has a continuous exhaust path and practice proves that it can be evacuated without any problem. The invention is based on the further recognition that the use of only inorganic material for the surface of the internal vacuum support in the device according to the invention results in an extremely good voltage stability so that the internal vacuum support of the device according to the invention can be used even at high post-acceleration voltages and electric fields. The internal vacuum support preferably consists entirely of an inorganic material, which simplifies the manufacture of the vacuum support.

A special embodiment of the picture display device according to the invention is characterized in that, at least at the display screen side, the cavities of the internal vacuum support are arranged in a pattern corresponding to the pattern of the pixels. The electrons are guided towards a pixel corresponding to the cavity and there is little risk of electrons impinging upon another pixel. The internal vacuum support shields the separate pixels and thus constitutes an adequate pixel separation for the device, which contributes to a higher contrast and, in a colour display device, also to a larger colour purity. If the internal vacuum support is arranged at a short distance from the first wall, the pixel shielding remains functional if the distance between the internal vacuum support and the first wall is of the order of the mutual distance between the pixels.

A further embodiment of the device according to the invention is characterized in that the cavities of the internal vacuum support gradually widen in the direction of the second wall and partly overlap at their wide end with adjacent cavities so as to form a hilly structure with which the internal vacuum support engages the second wall, such hilly structure forming the lateral system of ducts. Such a structure can easily be made by etching or spraying while using a mask corresponding to the pattern of the cavities, with intentional underetching being carded out until adjacent cavities overlap each other. The hilly structure thus formed provides the envisaged system of ducts at the side of the second wall, while the desired pixel separation is realised at the opposite side.

An alternative further embodiment of the device according to the invention is characterized in that the side of the internal vacuum support facing the second wall has a plurality of projections with which the internal vacuum support engages the second wall. In this case it is not necessary to form projections between all apertures. At the side of the second wall, a continuous, lateral exhaust path is realised by means of the projections, which ensures a sufficiently low exhaust resistance.

The internal vacuum support of the display device according to the invention may alternatively be composed of a plurality of separate plates instead of a single intermediate plate. A further special embodiment of the device according to the invention is, for example characterized in that the internal vacuum support comprises at least two stacked gratings having apertures which enclose a plurality of pixels, which apertures are bounded by upstanding walls, and in that the gratings are offset with respect to each other in at least one direction in such a way that the walls of both gratings extending transversely to this direction are not in contact with each other. In the last-mentioned device a continuous exhaust path is thus formed which is alternately present in one and in the other grating. If the gratings themselves provide an insufficient pixel separation, the internal vacuum support may be extended at the display screen side with an apertured plate comprising a pattern of apertures which corresponds to the pixel pattern. In a plan view, continuous cavities are thus formed which extend from the electron sources to the associated pixels, with adjacent pixels being adequately shielded from each other.

In addition to compensating for the external atmospheric pressure exerted on the device, the internal vacuum support may also be used to enhance the post-acceleration of electrons to the display screen. To this end a special embodiment of the device according to the invention is characterized in that at least one of the two gratings is provided with an electrically conducting layer at the side facing the first wall, which layer has an electrical connection. During operation, the conducting layer or layers are applied to a fixed, well-defined potential and thus constitute equipotential surfaces inhibiting a possible accumulation of charge in dielectric parts. Such a layer may already be provided on an initial substrate for forming the internal vacuum support and then simultaneously patterned. It is particularly possible to use a ductile aluminium layer for the relevant purpose.

An alternative embodiment of the picture display device according to the invention is characterized in that the continuous exhaust path of the internal vacuum support communicates with the exhaust connection via an exhaust cavity extending at least along one side of said support. The presence of an exhaust cavity results in a lower pumping resistance.

Another preferred embodiment of the picture display device according to the invention is characterized in that within the exhaust cavity a getter arrangement is situated. Provision of a getter arrangement improves the vacuum and thereby the life-time of the picture display device.

BRIEF DESCRIPTION OF THE DRAWING FIGURES

These and other aspects of the invention will be apparent from and elucidated with reference to the embodiments described hereinafter.

In the drawings.

The Figures are purely diagrammatic and not drawn to scale. For the sake of clarity, some dimensions are exaggerated. Similar components in the Figures are denoted by the same reference numerals as much as possible.

DESCRIPTION OF THE INVENTION

Figure 1A:
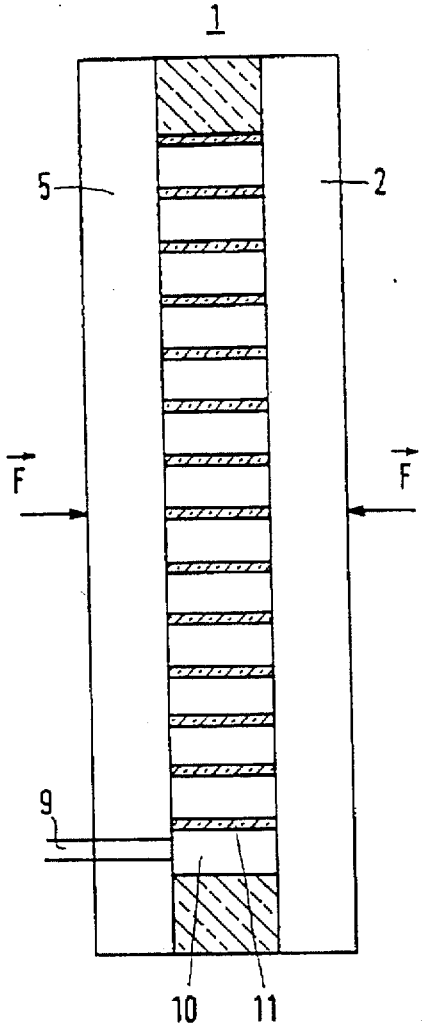
FIG. 1A is a cross-section of an embodiment of a picture display device.

The picture display device shown in FIG. 1A comprises an evacuated envelope 1 which is constituted by a substantially flat first wall, in this example the display panel 2, and a second wall arranged parallel thereto, in this example an emitter plate 5 which are mutually connected all round in a vacuumtight manner. The picture display device further comprises an exhaust connection 9, in this example in the emitter plate 5, which is closed (sealed) in a vacuumtight manner in the finished product but which ensures, during manufacture, an open connection with a vacuum pump by means of which the envelope 1 is brought to the desired vacuum pressure. To resist the force exerted by the atmospheric pressure (symbolically denoted by $\overline{F}$ in FIG. 1A) at a later stage, a gap 10 enclosed by the plates 2, 5 incorporates an internal vacuum support 11 which extends substantially throughout the display screen.

Figure 1B:
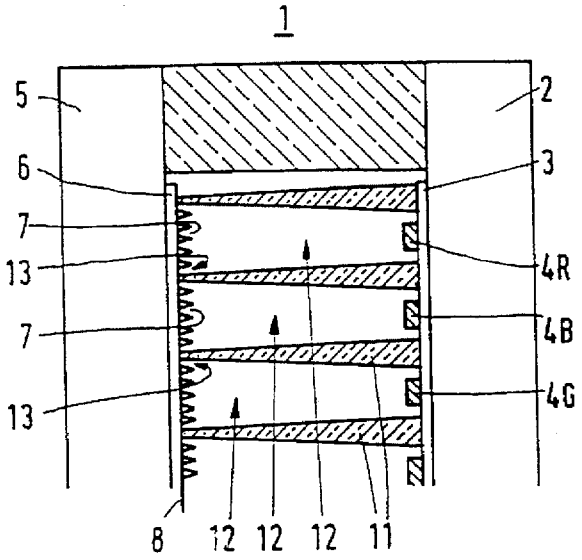
FIG. 1B is a cross-section of a first embodiment of the picture display device according to the invention.

FIG. 1B shows that the glass display panel 2 is provided at its inner side with a colour display screen 3 comprising a regular pattern of electroluminescent pixels 4R, 4G, 4B. Each pixel 4R, 4G, 4B comprises a suitable phosphor of the correct colour: red 4R, green 4G or blue 4B. The pixels may be exactly round, but other geometries may alternatively be used such as, for example a line pattern.

The emitter plate 5 comprises a substrate 6 of glass on which an electron source 7 is provided for each pixel 4RGB, which electron source consists of a group of metal field emitters. The groups of field emitters are connected by means of metal tracks 8 located on the substrate 6 and are further provided in the conventional manner with insulated gate electrodes which are not shown in the drawing for the sake of clarity. Instead of metal field emitters, field emitters of a different material such as, for example diamond and electron sources of other types may be used such as, for example pn cathodes and wire cathodes, both of which are frequently used in flat-panel picture display devices.

In this embodiment the internal vacuum support 11 comprises a plate of glass, macor (aluminium oxide) or another suitable dielectric and inorganic material. The invention is based on the recognition that the use of inorganic material for the internal vacuum support prevents graphite tracks from being formed at a possible electric flashover. Consequently, the internal vacuum support of the device according to the invention has an extremely large voltage stability and may thus be used at comparatively high post-acceleration voltages.

The internal vacuum support accommodates conical cavities 12 which widen in the direction of the emitter plate 5. The cavities are formed by means of powder spraying while masking with a mechanical mask consisting of a metal apertured plate. Powder spraying is continued for such a long time that the cavities 12 partly overlap each other at their wide ends 13.

Figure 1C:
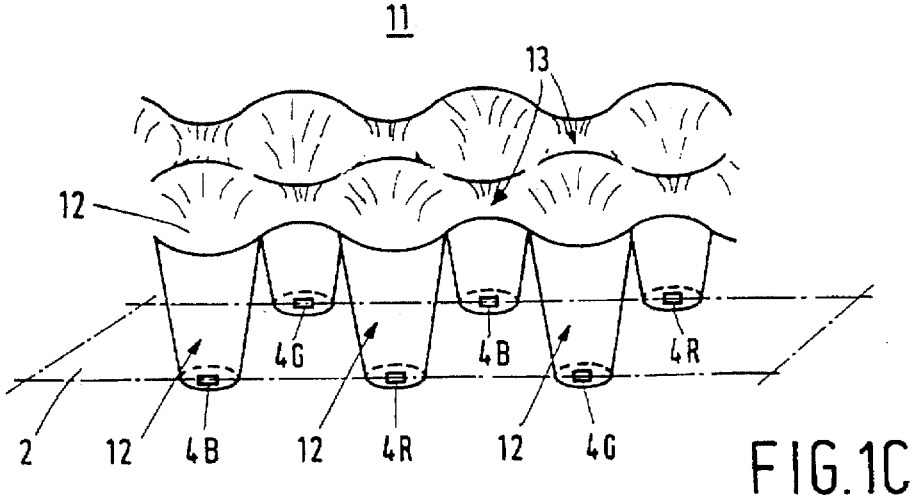
FIG. 1C is an elevational view of an internal vacuum support of a picture display device according to the invention.

FIG. 1C shows that the wide ends 13 thus form a hilly structure with which the internal vacuum support engages the emitter plate. It is to be noted that the cavities need not be purely conical for such a structure. It is sufficient when the cavities gradually widen and overlap each other in the direction of the emitter plate. The wide ends 13 of the cavities 12 constitute a lateral system of ducts. The cavities 12 constitute a regular pattern corresponding to that of the pixels 4RGB and to that of the groups of field emitters 7. The pixels 4RGB are thereby completely shielded so that the internal vacuum support also constitutes an adequate pixel separation. Thus, it is avoided that a pixel is impinged by electrons coming from an electron source associated with an adjacent pixel, which enhances the contrast and the colour purity of the displayed picture of the device. It is not necessary that each cavity 12 faces only one pixel as each cavity 12 may face a group of, for example, three pixels comprising phosphors for the three different colours 4R, 4G, 4B.

Thanks to the hilly structure of the internal vacuum support at the side of the second wall and the associated system of ducts, the cavities in the internal vacuum support are not closed at their side facing the second wall but communicate with an exhaust path to the exhaust connection. As a result, the exhaust resistance of the entire device remains comparatively low, while nevertheless a complete pixel separation is realised. During manufacture, the device may therefore be evacuated sufficiently rapidly.

Figure 2A:
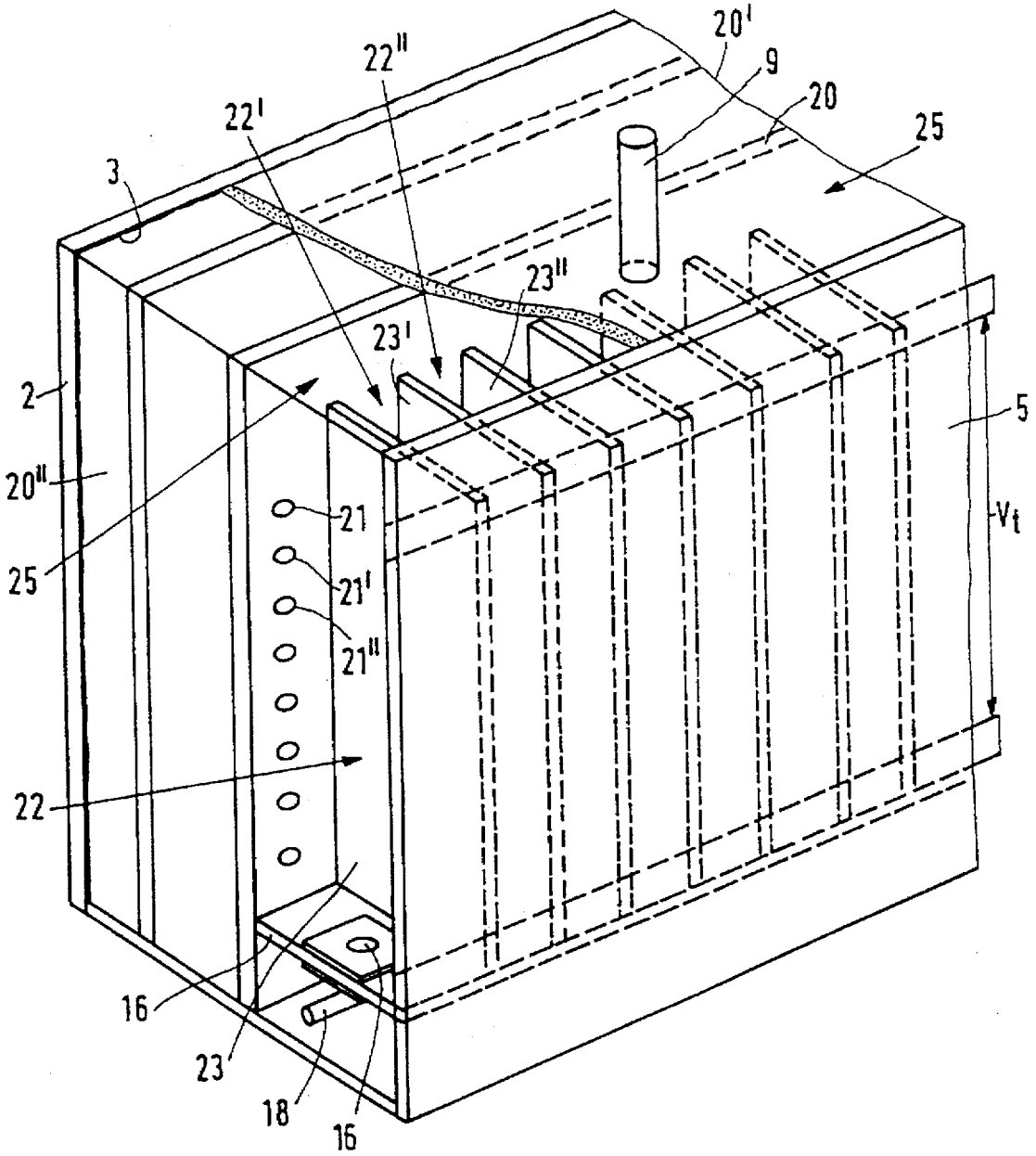
FIG. 2A is an elevational view of an insulating electron duct display.

FIG. 2A is a diagrammatic elevational view of an insulating electron duct display. A number of plates 20, 20', 20", . . . provided with apertures 21, 21', 21", . . . is present between a first wall 2 and a second wall 5. The glass display panel 2 is provided at an inner side with a colour display screen 3 comprising a regular pattern of electroluminescent pixels. In contrast to the foregoing example, the second wall 5 does not constitute the emitter plate but the rear wall 5 constitutes an electron transport plate. The transport ducts 22, 22', 22', . . . separated by the partitions 23, 23', 23", . . . cooperate via a cathode plate 16 provided with apertures 17 with at least a line-shaped electron source 18. Such a picture display device is described in EP-A 400750 and EP-A 436997.

An exhaust connection 9, in this example at the upper side of the insulating electron duct display, which is closed (sealed) in a vacuumtight manner in the finished product, ensures an open connection from a vacuum pump via the exhaust cavity 25 to the transport ducts 22, 22', 22", . . . during manufacture of the picture display device. Since the partitions 23, 23', 23", . . . do not completely extend as far as the end of plate 20, a lateral system of parallel ducts 22, 22', 22", . . . is realised which at least at one end communicate with each other and with an exhaust connection 9. In another embodiment both the rear plate 5 and the plate 20 are extended in at least one direction and thus enclose the exhaust cavity 25. Moreover, plate 20 and partitions 23, 23', 23", . . . may be made from one plate. The exhaust connection 9 may be present at the side of cavity 25, inter alia as in the rear wall 5. The exhaust cavity 25 may also be used to accommodate a getter arrangement.

Figure 2B:
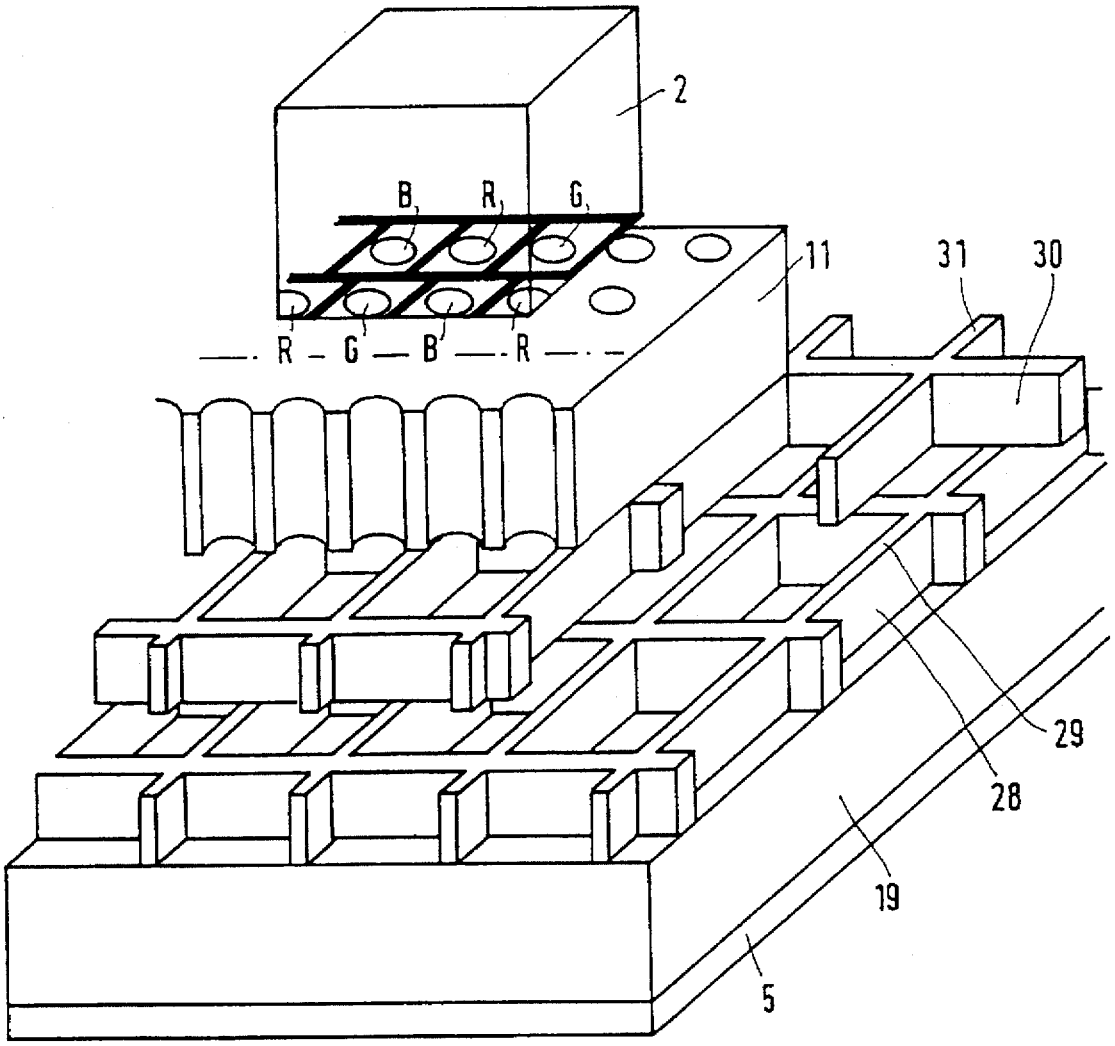
FIG. 2B is an elevational view of a second embodiment of an internal vacuum support of a picture display device according to the invention.

In the relevant case, the internal vacuum support is not constituted by a single plate but by a combination of a plurality of separate parts 20, 20', 20", . . . . A second embodiment of an internal vacuum support of the picture display device according to the invention is shown in FIG. 2B and, in this example comprises two stacked gratings 28, 30 and an apertured plate 11 of glass. If desired, other inorganic materials such as, for example macor and other ceramic materials may be used for the components of the internal vacuum support. The apertures in the two gratings 28, 30 are dimensioned in such a way that they enclose a plurality of pixels "R", "G", "B". Since the gratings are offset with respect to each other by half an aperture in both directions, the walls of the two gratings in both directions are not in contact with each other. Thus, a three-dimensional system of ducts is obtained which extends laterally and alternately lies in the one and in the other grating. This duct system provides a continuous exhaust path from the cavities in the apertured plate 11 to the exhaust connection so that the entire device can be efficiently exhausted in a short time.

Such an exhaust path is also produced if the gratings are offset with respect to each other in a single direction. In this case the exhaust path extends in that direction. However, by offsetting the gratings in both directions, similarly as in this case, a further decrease of the exhaust resistance is achieved.

Also in this case, the apertures in the apertured plate 11 are arranged in a pattern corresponding to that of the pixels. Adjacent pixels are thus adequately separated from each other so that a picture having a good colour purity and a high contrast can be achieved. The apertured plate 11 may be dispensed with, if the combination of both gratings already provides a sufficient pixel separation of itself.

In the present embodiment both gratings 28, 30 are provided at their side facing the display screen with an electrically conducting layer 29, 31 of aluminium in this case, which is provided with an electric connection (not shown). During operation, the conducting layers 29, 31 are brought via their connections to well-defined potentials so as to form equipotential planes so that accumulation of charge in the insulating parts of the internal vacuum support is inhibited, which further contributes to the (high-)voltage stability of the device. In so far as the operating voltages applied in a practical case allow, it will be evident that such conducting layers may be dispensed with. Moreover, instead of two gratings it is alternatively possible to use more gratings, which provides the opportunity of accommodating more conducting layers and hence a more gradual voltage variation in the internal vacuum support.

Figure 3A:
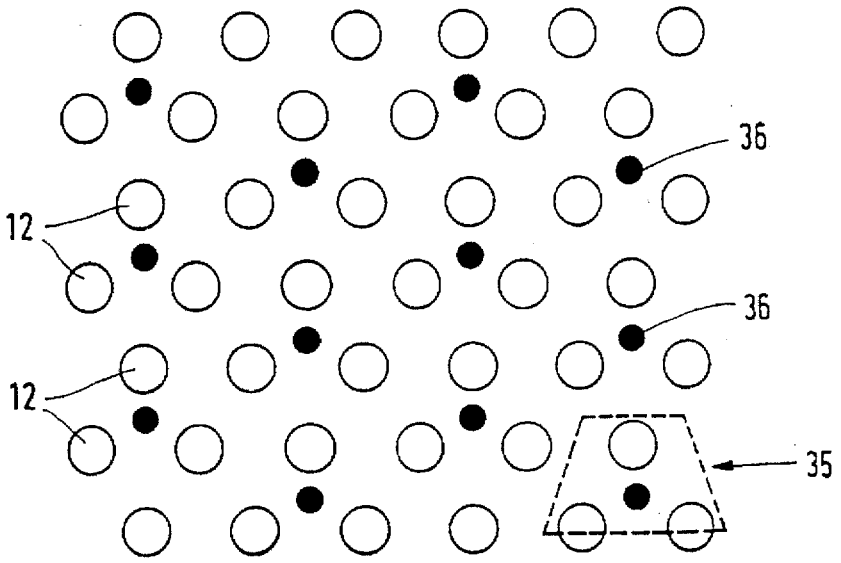
FIG. 3A is a cross-section of an internal vacuum support.
Figure 3B:
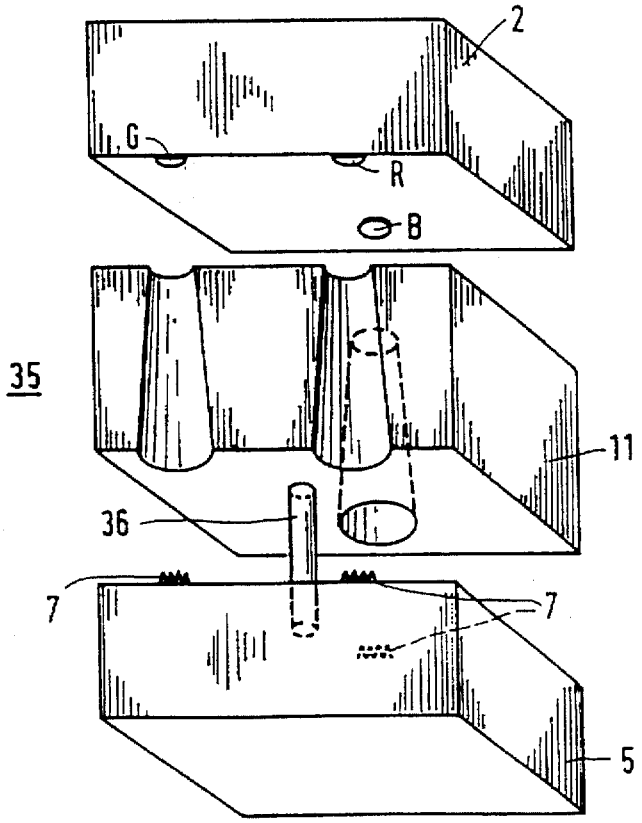
FIG. 3B is an elevational view of a third embodiment of an internal vacuum support of a picture display device according to the invention.

In a third embodiment which is shown in a diagrammatic cross-section in FIG. 3A and an elevational view of a detail 35 of which is shown in FIG. 3B, the device comprises an internal vacuum support in the gap between the emitter plate 5 and the display panel 2, which support is constituted by an apertured plate 11 having a pattern of cavities corresponding to that of the pixels "R", "G", "B" and engaging the emitter plate by means of projections 36. In this case the apertured plate 11 is made of glass, macor or another relatively hard, inorganic material, while the projections 36 are formed from a relatively corrosive glass paste. A conducting material such as, for example aluminium is preferably used for the ductile layer which is provided with an electric connection. During operation, a fixed potential can be applied to the layer and the layer, likewise as the conducting layers in the previous example, constitutes a well-defined equipotential plane in the ultimate device, which inhibits accumulation of charge in the further insulating vacuum support.

To manufacture the internal vacuum support of the relevant embodiment, a substrate for the apertured plate is successively coated with a ductile layer of aluminium, a dried layer of glass paste and a suitable photoresist defining the location of the ultimate projections. At the opposite side, the substrate is provided with a mechanical mask having the cavity pattern and the cavities are provided in the substrate by means of powder spraying. The cavities extend into the glass paste layer. The projections are formed also by means of powder spraying at the first side while masking the photoresist. The ductile aluminium layer ensures that the vulnerable projections are not affected by powder particles reflected on the substrate. In fact, it is not necessary that there is a projection between each pair of adjacent cavities. It is sufficient when a sufficiently large number of projections is scattered across the apertured plate. The mechanical mask of the cavities and the photoresist of the projections thus need not be aligned in a critical manner. Both powder spraying operations may be performed simultaneously or consecutively.

A preferred embodiment of the picture display device according to the invention is characterized in that the system of ducts of the internal vacuum support communicates with the exhaust connection via an exhaust cavity extending at least along one side of said internal vacuum support such as the exhaust cavity 25 as shown in FIG. 2A. The presence of an exhaust cavity results in a lower pumping resistance. During manufacture of the picture display device, a faster pumping cycle is realized and/or a better vacuum can be reached.

Preferably, the walls of the exhaust cavity comprise parts of the first and the second wall interconnected by an intermediate plate, said intermediate plate comprising the exhaust connection. In normal practice the exhaust connection is connected to the second wall by making an opening in the second wall. In general, this can only be done after the second wall has been completely processed, i.e. the electron source(s) are arranged on the second wall in the case that said wall is the emitter plate. Any damage to the second wall renders said wall useless for further use. The inventors have realized that by incorporating the exhaust connection in the intermediate plate such problems are overcome.

Figure 4A:
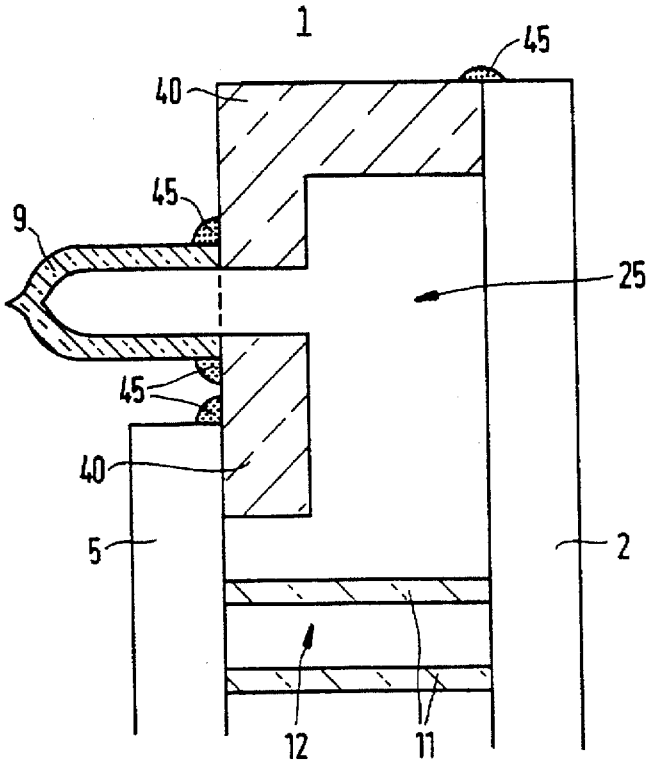
FIG. 4A is a cross-section of an embodiment of a picture display device comprising an internal vacuum support and an exhaust cavity according to the invention.

In FIG. 4A a cross-sectional view of an picture display device is shown comprising an evacuated envelope 1 comprising a substantially flat first wall, in this example the display panel 2, and a second wall arranged parallel thereto, in this example an emitter plate 5. For the sake of clarity FIG. 4A does not show that first wall 2 is provided at its inner side with a colour display screen comprising a regular pattern of electroluminescent pixels and that second wall 5 comprises a substrate of glass on which an electron source is provided for each pixel (see FIG. 1B). Both walls 2, 5 are mutually connected by an intermediate plate 40. In this embodiment the intermediate plate 40 is sealed to the walls 2, 5 by means of the seals 45. In addition, the intermediate plate 40 comprises an exhaust connection 9 sealed to the intermediate plate 40 by means of the seals 45. The exhaust connection 9 is closed in a vacuumtight manner in the finished product but ensures, during manufacture, an open connection with a vacuum pump by means of which the envelope 1 is brought to the desired vacuum pressure.

In the embodiment of the picture display device of FIG. 4A the exhaust connection 9 is directed transverse with respect to second wall 5. The internal vacuum support 11 accommodates cavities 12 which constitute a lateral system of ducts. The continuous exhaust path of the internal vacuum support 11 communicates with the exhaust connection 9 via an exhaust cavity 25. During manufacture, the device may therefore be evacuated rapidly.

Figure 4B:
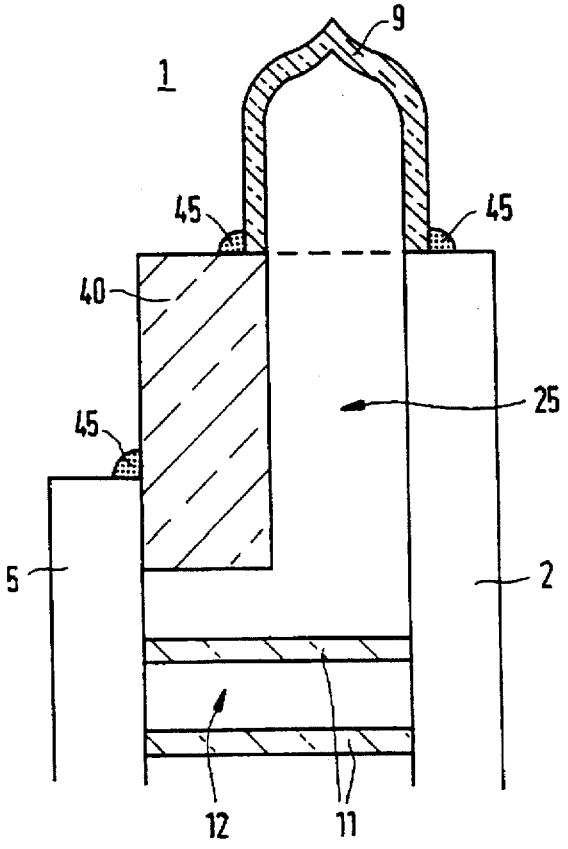
FIG. 4B is a cross-section of an embodiment of a picture display device comprising an internal vacuum support and an exhaust cavity according to the invention.

In FIG. 4B a similar embodiment of an picture display device comprising an exhaust cavity 25 is shown. In this example the exhaust connection 9 is sealed by means of seals 45 at one side to intermediate plate 40 and at the other side to first wall 2. In a similar way, the exhaust connection 9 can be sealed one side to intermediate plate 40 and at the other side to second wall 5. In the embodiment of the picture display device of FIG. 4B the exhaust connection 9 is directed substantially parallel with respect to first wall 2. An advantage of positioning the exhaust connection 9 parallel to the first wall 2 is a substantially reduced total thickness of the picture display device.

The intermediate plate 40 is preferably made of glass, macor or another relatively hard, inorganic material. The internal vacuum support 11 and the intermediate plate 40 can be comprised in the same element.

Figure 5A:
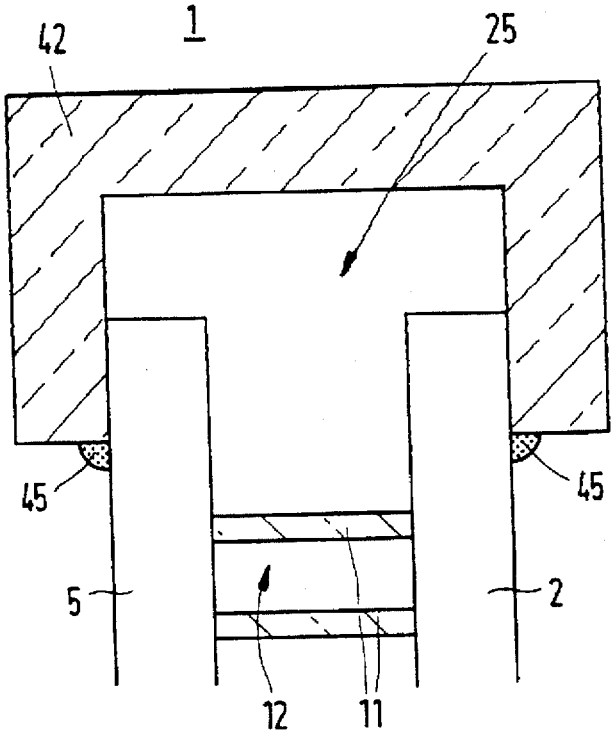
FIG. 5A is a cross-section of an embodiment of a picture display device comprising an internal vacuum support and an exhaust cavity according to the invention.
Figure 5B:
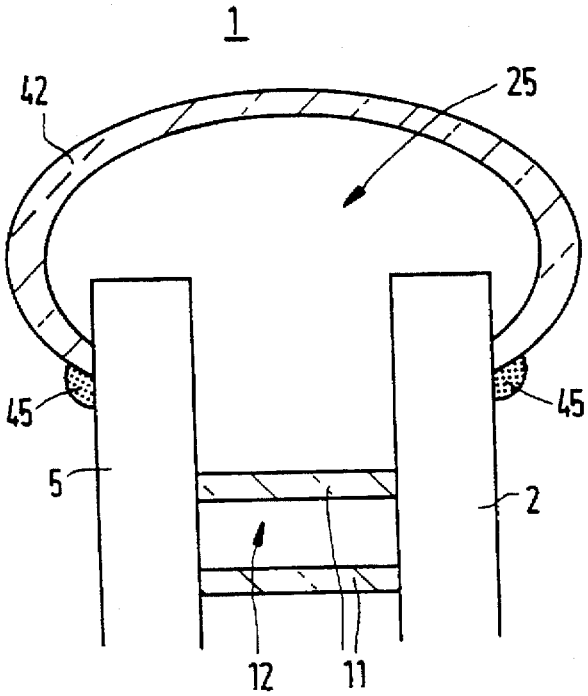
FIG. 5B is a cross-section of an embodiment of a picture display device comprising an internal vacuum support and an exhaust cavity according to the invention.

Another preferred embodiment of the picture display device according to the invention is characterized in that the walls of the exhaust cavity comprise parts of the first and the second wall interconnected by a hollow member comprising a groove which fits around said walls, said hollow member comprising the exhaust connection. In FIG. 5A the hollow member 42 is angularly shaped whereas in FIG. 5B the hollow member 42 is tubularly shaped. The internal vacuum support 11 accommodates cavities 12 which constitute a lateral system of ducts. The continuous exhaust path of the internal vacuum support 11 communicates via the exhaust cavity 25 with an exhaust connection (not shown in FIGS. 5A and 5B). Preferably, the hollow member is closed at one end and comprises the exhaust connection at the other side. It is possible that each side of the hollow member 42 comprises an exhaust connection. The hollow member 42 is preferably made of glass, macor or another relatively hard, inorganic material or can be made of a metallic material. Some flexibility of the wall(s) of the hollow member 42 facilitates the securing of the hollow member 42 to walls 2, 5.

The inventors have realized that the presence of the exhaust cavity 25 in the picture display device offers the possibility to deposit a getter material on the wall of the exhaust cavity. A preferred embodiment of the picture display device according to the invention is characterized in that within the exhaust cavity a getter arrangement is situated. Provision of a getter arrangement improves the vacuum and thereby the life-time of the picture display device. The getter material may also be deposited on the inside wall of the hollow member 42.

Although the invention has been described with reference to the shown embodiments, it will be evident that the invention is by no means limited to these embodiments and that many variations and designs within the scope of the invention can be conceived by those skilled in the art. For example, the device may be provided with an internal vacuum support formed as an apertured plate in which the side facing the emitter is provided with lateral ducts by means of etching or powder spraying, which ducts constitute a continuous exhaust path from the cavities to the exhaust connection. Such a continuous exhaust path may also be obtained by using an extra plate with a lateral duct structure.

In the second embodiment, a material other than aluminium may be used for the conducting layers such as, for example a resistance layer of, for example doped or undoped tin oxide or chromium oxide, another suitable metal or a combination of both. If such a conducting layer is dispensed with, the separate gratings may also be integrated by starting from an extra thick substrate and by exposing it bilaterally to a powder spraying or etching operation.

Moreover, the high-voltage stability of the internal vacuum support may be further enhanced by providing a coating having a low secondary emission coefficient in the apertures and cavities. To realise even higher post-acceleration voltages or an even lower exhaust resistance and improve colour purity and contrast, a larger number of plates and combinations of plates may be used for the internal vacuum support.

The invention generally provides an evacuated picture display device having an internal vacuum support which combines a large high-voltage stability with an adequate pixel separation and a low exhaust resistance.

We claim:

1. A picture display device comprising an evacuated envelope including a first, at least substantially flat transparent wall provided with a display screen having a regular pattern of electroluminescent pixels, and a second, at least substantially flat wall extending parallel to the first wall, at least one electron source, while in a gap between the first and the second wall an internal vacuum support is arranged having apertures for passing electrons to the pixels, wherein at least the side of the internal vacuum support facing the display screen comprises a dielectric plate which is arranged opposite the display screen and is provided with cavities, each cavity facing at least one pixel, in that the internal vacuum support comprises a lateral system of ducts, each cavity communicating with at least one duct, each duct communicating with an exhaust connection, and in that at least the surface of the internal vacuum support consists of an inorganic material.

2. A picture display device as claimed in claim 1, wherein the cavities of the internal vacuum support gradually widen in the direction of the second wall and partly overlap at their wide end with adjacent cavities so as to form a hilly structure with which the internal vacuum support engages the second wall, said hilly structure forming the lateral system of ducts.

3. A picture display device as claimed in claim 1, wherein the side of the internal vacuum support facing the second wall includes a plurality of projections with which the internal vacuum support engages the second wall.

4. A picture display device as claimed in claim 1, wherein the internal vacuum support comprises at least two stacked gratings having apertures which enclose a plurality of pixels, which apertures are bounded by upstanding walls, and in that the gratings are offset with respect to each other in at least one direction in such a way that the walls of both gratings extending transversely to this direction are not in contact with each other.

5. A picture display device as claimed in claim 4, wherein the gratings are separated from the display screen by a plate comprising a pattern of apertures corresponding to the pixel pattern.

6. A picture display device as claimed in claim 4, wherein at least one of the two gratings is provided with an electrically conducting layer at the side facing the first wall, which layer has an electric connection.

7. A picture display device as claimed in claim 1, wherein the lateral duct system comprises parallel ducts which communicate with each other and with an exhaust connection at at least one end.

8. A picture display device as claimed in claim 1, wherein the system of ducts of the internal vacuum support communicates with the exhaust connection via an exhaust cavity extending at least along one side of said internal vacuum support.

9. A picture display device as claimed in claim 8, wherein the walls of the exhaust cavity comprise parts of the first and the second wall interconnected by an intermediate plate, said intermediate plate comprising the exhaust connection.

10. A picture display device as claimed in claim 8, wherein the walls of the exhaust cavity comprise parts of the first and the second wall interconnected by a hollow member comprising a groove which fits around said walls, said hollow member comprising the exhaust connection.

11. A picture display device as claimed in claim 8, wherein within the exhaust cavity a getter arrangement is situated.

12. A picture display device comprising an evacuated envelope including a display screen having a pattern of electroluminescent pixels, a wall spaced apart from and at least substantially parallel to said display screen so as to form a gap therebetween, at least one electron source disposed intermediate said display screen and said wall, an internal vacuum support disposed in said gap and including apertures for passing electrons to the pixels; wherein said internal vacuum support includes a plate of at least one of an inorganic and dielectric material in facing alignment with said display screen, said plate including a plurality of cavities forming at one end a plurality of ducts, each of said cavities in facing alignment with at least one pixel; and an exhaust connection for regulating the vacuum pressure in said envelope wherein each of said ducts is in communication with said exhaust connection via an exhaust path.

* * * * *